US009876319B2

(12) United States Patent
Zhao et al.

(10) Patent No.: US 9,876,319 B2
(45) Date of Patent: Jan. 23, 2018

(54) ELECTROMAGNETIC INTERFERENCE (EMI) SHIELD

(71) Applicant: Cisco Technology, Inc., San Jose, CA (US)

(72) Inventors: Huasheng Zhao, Shanghai (CN); Zheng Yin, Shanghai (CN); Hongmei Fan, Shanghai (CN); Yingchun Shu, Shanghai (CN); Jinghan Yu, Shanghai (CN); Alpesh Bhobe, San Jose, CA (US)

(73) Assignee: CISCO TECHNOLOGY, INC., San Jose, CA (US)

( * ) Notice: Subject to any disclaimer, the term of this patent is extended or adjusted under 35 U.S.C. 154(b) by 0 days.

(21) Appl. No.: 14/326,280

(22) Filed: Jul. 8, 2014

(65) Prior Publication Data

US 2016/0006184 A1 Jan. 7, 2016

(51) Int. Cl.

| | |
|---|---|
| ***H01R 13/6581*** | (2011.01) |
| ***H01R 13/6584*** | (2011.01) |
| ***H01R 13/6596*** | (2011.01) |
| ***H01R 13/03*** | (2006.01) |
| ***H01R 13/74*** | (2006.01) |
| ***H01R 24/64*** | (2011.01) |
| ***H01R 13/6598*** | (2011.01) |

(52) U.S. Cl.

CPC ..... *H01R 13/6596* (2013.01); *H01R 13/03* (2013.01); *H01R 13/6598* (2013.01); *H01R 13/74* (2013.01); *H01R 24/64* (2013.01); *H01R 13/6584* (2013.01)

(58) Field of Classification Search

CPC . H01R 13/6584; H05K 9/0015; H05K 9/0018
USPC ..... 439/607.17–607.19, 544, 550, 556, 559, 439/562, 563, 565
See application file for complete search history.

(56) References Cited

U.S. PATENT DOCUMENTS

| | | | | |
|---|---|---|---|---|
| 5,202,536 A * | 4/1993 | Buonanno | ..... | 174/356 |
| 5,748,449 A * | 5/1998 | Tahmassebpur | ..... | H05K 9/0049 174/354 |
| 6,477,061 B1 * | 11/2002 | Johnson | ..... | G06F 1/182 174/351 |
| 7,723,621 B2 * | 5/2010 | Megason | ..... | H05K 9/0016 174/354 |

(Continued)

FOREIGN PATENT DOCUMENTS

DE 10 2006 006565 A1 8/2007

OTHER PUBLICATIONS

International Search Report and Written Opinion for International Application No. PCT/US2015/038910, dated Sep. 18, 2015.

*Primary Examiner* — Renee Luebke
*Assistant Examiner* — Paul Baillargeon
(74) *Attorney, Agent, or Firm* — Polsinelli PC

(57) ABSTRACT

A shield is described for minimizing leakage of electromagnetic waves from a connector/chassis interface. The shield includes a conductive strip sized to at least partially surround an aperture in a chassis, where the chassis receives a connector port assembly through the aperture. The conductive strip includes an outer portion affixed to an interior surface of the chassis, and an inner portion able to be manipulated to at least partially cover one or more gaps between the connector port assembly and the chassis.

20 Claims, 2 Drawing Sheets

(56) References Cited

U.S. PATENT DOCUMENTS

| | | | | |
|---|---|---|---|---|
| 8,157,593 | B1 * | 4/2012 | Sim et al. | 439/607.28 |
| 2003/0037418 | A1 | 2/2003 | Lenhart et al. | |

* cited by examiner

ELECTROMAGNETIC INTERFERENCE (EMI) SHIELD

CROSS REFERENCE TO RELATED APPLICATIONS

N/A

TECHNICAL FIELD

The present disclosure relates to an apparatus and method for minimizing electromagnetic wave leakage from gaps between a connector port and a chassis.

BACKGROUND

A common problem in high frequency input/output ports is the electromagnetic interference ("EMI") or leakage from gaps between the connector port and the chassis. When a gap between the connector port and the chassis is not filled with conductive material or the electrical contact between them is not sufficient, EMI will occur. Current solutions have proven to be inadequate, are difficult to design, and/or are cost prohibitive.

BRIEF DESCRIPTION OF THE DRAWINGS

There are shown in the drawings embodiments that are presently preferred it being understood that the disclosure is not limited to the arrangements and instrumentalities shown, wherein.

DESCRIPTION OF EXAMPLE EMBODIMENTS

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a more thorough understanding of the subject technology. However, it will be clear and apparent that the subject technology is not limited to the specific details set forth herein and may be practiced without these details. In some instances, structures and components are shown in block diagram form in order to avoid obscuring the concepts of the subject technology.

Overview

In one aspect of the present disclosure, a method for limiting EMI at an interface between a connector port assembly and a chassis is provided. The method includes affixing an outer portion of a conductive strip to an interior surface of a chassis, the chassis containing an aperture sized to receive a connector port assembly. The outer portion of the conductive strip is disposed around a perimeter of the aperture. The method further includes inserting the connector port assembly within the aperture of the chassis, the connector port assembly containing one or more connector ports, and manipulating an inner portion of the conductive strip in order to cover one or more gaps between the connector port assembly and the chassis.

In another aspect, a shield is provided, where the shield includes a conductive strip sized to at least partially surround an aperture in a chassis, the chassis configured to receive a connector port assembly through the aperture. The conductive strip includes an outer portion affixed to an interior surface of the chassis, and an inner portion, the inner portion able to be manipulated to at least cover one or more gaps between the connector port assembly and the chassis.

In yet another aspect, a chassis is provided where the chassis includes a receptacle for receiving a connector port assembly therethrough, the receptacle having an interior surface and an exterior surface, and a conductive strip surrounding an aperture in the receptacle. The conductive strip includes an outer portion affixed to the interior surface of the receptacle, and an inner portion adapted to be manipulated in order to cover one or more gaps between the connector port assembly and the chassis.

Detailed Description

Figure 1:
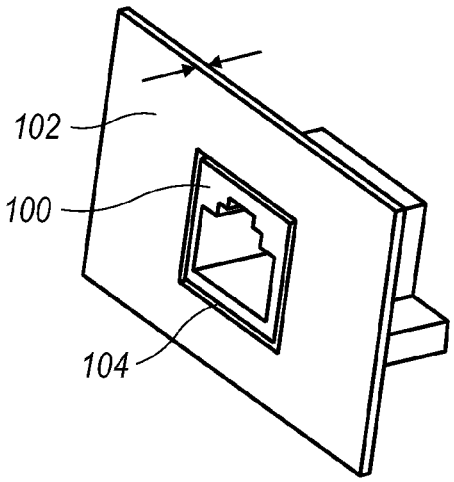
FIG. 1 illustrates an interface between a connector port and chassis for which an example of the present disclosure may be used.
Figure 4:
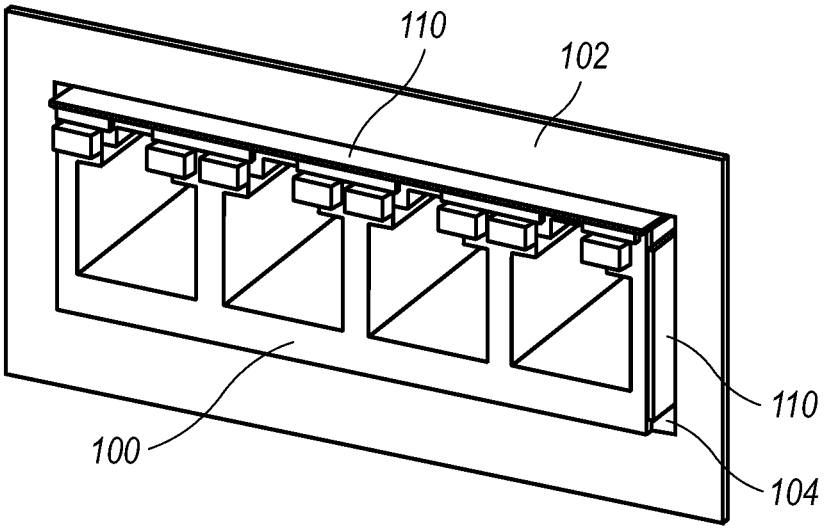
FIG. 4 illustrates the electromagnetic interference shield of the present disclosure filling the gap between the connector port and chassis.

The present disclosure describes an apparatus and method that can minimize EMI between gaps formed between a connector port and a chassis, while overcoming the deficiencies in current designs. Connector port 100 is a conductive enclosure adapted to receive a connector, such as, for example, a telephone or computer cable. FIG. 1 illustrates a typical interface between connector port and a chassis 102, showing a gap 104 that is formed at the interface of connector port 100 and chassis 102. In this example, gap 104 exists around the outer periphery of connector port 100 and chassis 102. The example shown in FIG. 1 is a single connector port 100 situated within a chassis 102. Chassis 102 is a receptacle that receives one or more connector ports 100. Chassis 102 has a thickness shown by the arrows in FIG. 1. This thickness can vary depending upon design constraints. While the apparatus and method described herein can be adapted to a single connector port 100/chassis 102 interface shown in FIG. 1, it can also be adapted to multiple connector ports 100 forming a connector port assembly, fit within a single chassis 102, as shown in FIG. 4, and described in the examples below. FIG. 1 depicts a typical connector port 100 affixed within chassis 102. In high frequency ports, there is constant unwanted leakage of electromagnetic waves from gap 104 formed between the exterior perimeter of connector port 100 and chassis 102 due to the absence of conductive material in these locations. Similarly, in a multiple connector port scenario, electromagnetic wave leakage can occur at various points along the connector port 100/chassis 102 interface.

Figure 2:
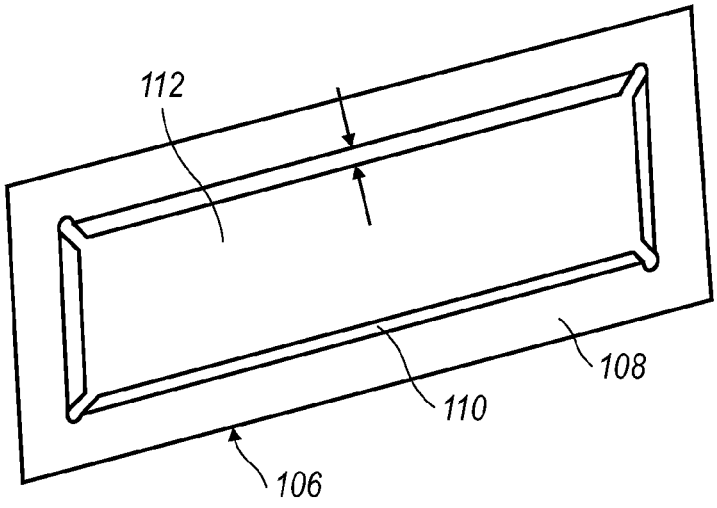
FIG. 2 illustrates an example of the electromagnetic interference shield of the present disclosure.

FIG. 2 illustrates an exemplary electromagnetic interference shield 106 of the present disclosure. Shield 106 is a conductive strip that can include conductive material having a high electrical conductivity and/or low electrical resistivity. For example, shield 106 could be a conductive gasket made of conductive material such as Beryllium copper, a conductive sheet, or conductive foam.

Shield 106 is sized to accommodate the size of connector port 100 and shield 102 and thus can be of different shapes and sizes. Thus, shield 106 need not be of the rectangular configuration depicted in FIG. 2, but can be sized to accommodate a single connector port, or multiple connector ports, according to need. In one embodiment, and as further described below, shield 106 surrounds or otherwise encircles an aperture 112 in chassis 102 which will receive connector port 100 therethrough. It is from gaps 104 that exist between aperture 112 in chassis 102 and connector port 100 through which unwanted electromagnetic wave leakage occurs.

As shown in FIG. 2, shield 106 includes two portions. An outer portion 108 of the strip that is affixed to the interior of chassis 102 and a pliable inner portion 110 of the strip that is not affixed to the interior chassis 102. The dimensions of outer portion 108 and pliable inner portion 110 of shield 106 can vary depending on design constraints, including the dimensions of the connector port or ports 100 that are used, and the thickness of chassis 102. For example, outer portion 108 of shield 106 might be a very narrow strip, leaving the remainder of shield 106 to be the inner portion 110. While both outer portion 108 and inner portion 110 are both made of conductive material as described above, inner portion 110 of shield 106 is pliable and can be bent, folded, or otherwise manipulated to cover the outer edges of connector port 100 after connector port 100 is inserted within chassis 102. While outer portion 108 can also be formed of a pliable material, it need not be.

In another example, inner portion 110 has a width, identified by the arrows in FIG. 2, and measured from the bottom of outer portion 108 to aperture 112, that is the same or substantially the same as the thickness of chassis 102. The thickness of chassis 102 is shown by the arrows in FIG. 1. Inner portion 110 acts as a bendable "flap" that, when connector 100 is inserted within the opening in chassis 102, can be manipulated to cover any gaps that might exist in the interface between connector port 100 and chassis 102.

Figure 3:
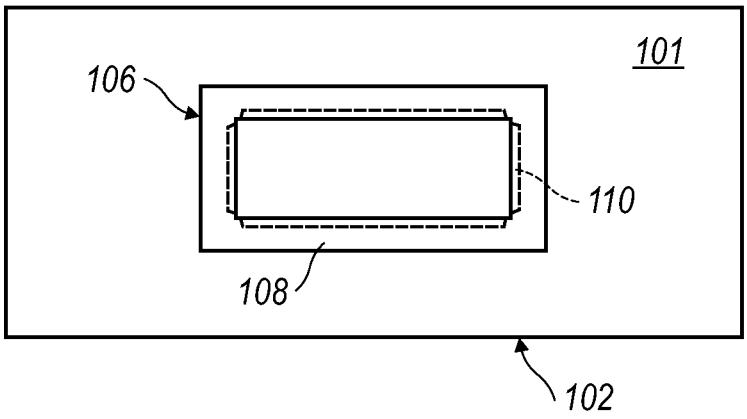
FIG. 3 illustrates a portion of the electromagnetic interference shield of the present disclosure affixed to the interior side of the chassis.

Chassis 102 has an exterior surface (not shown in FIG. 3) and an interior surface 101. FIG. 3 shows outer portion 108 of shield 106 affixed to interior surface 101. Chassis 102 has an aperture 112 that is sized to receive connector port 100 or a plurality of connector ports, i.e., a connector port assembly. Outer portion 108 of shield 106 is affixed to interior surface 101 of chassis 102 around aperture 112. Outer portion 108 of shield 106 could be affixed to interior surface 101 using glue or other similar substance or by any other affixing mechanism known in the art. Inner portion 110 of shield 106 is not affixed to chassis 102 but extends at least partially within aperture 112.

In practice, inner portion 110 is able to be manipulated, folded, shaped or bent to conform to the dimensions of the connector port 100 that is inserted in chassis 102 through aperture 112 in order to cover gaps 104 existing at the interface between connector port 100 and chassis 102. In other words, when connector 100 port is inserted into chassis 102, any seams or gaps that exist at the interface between connector 100 port and chassis 102 can be covered by inner portion 110. While outer portion 108 remains affixed to the interior portion 101 of chassis 102, inner portion 110 serves as a flap or lip and can be bent at a desirable angle in order to cover openings and gaps at the interface between connector port 100 and chassis 102.

FIG. 4 illustrates a connector port assembly containing one or more connector ports 100 inserted in chassis 102. The connector port assembly is shown to include a number of side-by-side connector ports 100, in this example, four connectors ports. Thus, chassis 102 includes aperture 112 that is sized to receive the connector port assembly of a particular size and shape. Similarly, shield 106 is sized to be affixed to the interior surface 101 of chassis 102 around aperture 112. Note that the configuration of connector port 100, chassis 102, and shield 106 is exemplary only and shield 106 can be sized to accommodate different sized apertures 112, and chassis thicknesses.

After outer portion 108 of shield 106 has been affixed to interior surface 101 of chassis 102 as described above, the connector port assembly containing one or more connector ports 100 is inserted into aperture 112 of chassis 102. As discussed above, after insertion, there are spaces and gaps that are formed between connector port 100 or a multi-connector port connector assembly and chassis 102 through which electromagnetic waves can escape. Advantageously, inner portion 110 of shield 106 acts as a flap around the perimeter of connector port 100, and can be manipulated to cover gaps 104 at the interface between the connector ports 100 of the connector port assembly and chassis 102. As shown in FIG. 4, inner portion 110 of shield 106, which is not affixed to chassis 102, extends through aperture 112 and is bent or otherwise manipulated to fold down along the outer edges of the connector port assembly or wherever any gaps 104 occur in order to cover any spaces or gaps 104 that might exist when the connector port assembly is secured within chassis 102. In one example, inner portion 110 is folded at substantially 90 degrees with respect to the front surface of chassis 102 in order to form an "L-shape", as shown in FIG. 4. However, it is understood that inner portion 110 of shield 106 can be folded at any angle in order to cover up gaps 104 that are formed between the connector port assembly and chassis 102.

FIG. 4 shows a top tab and a right side tab of inner portion 110 of shield 106 folded against a corresponding side of the connector assembly. Although not shown in this figure, the left and bottom tabs of inner portion 110 can also be bent to cover corresponding left side and bottom sides of the connector port assembly. Thus, one or more sides of inner portion 110 can extend through aperture 112 to cover portions of the connector port assembly, which contains one or more connector ports 100. Although the top and side edge tabs of inner portion 110 are shown to be folded approximately 90 degrees with respect to the front edge of the chassis, this is exemplary only.

Thus, inner portion 110 of shield 106 serve as conductor "flaps" that can be manipulated, bent or folded along the outer periphery of the interface between the connector port assembly and chassis 102, as needed, to cover gaps 104. In one example, some or all of the flaps have a length that is the same or substantially the same as the thickness of chassis 102. Thus, when folded, each tab of inner portion 110 of shield 106 will be substantially flush with chassis 102. By manipulating the flexible inner portion 110 of shield 106, each "flap" constitutes a piece of conductive material that can cover the spaces or gaps 104 that may exist between the interface of the connector port assembly and chassis 102 in order to prevent or minimize EMI.

In the examples discussed herein and depicted in the figures, shield 106 can be used to minimize the escape of unwanted electromagnetic waves through gaps 104 formed at the connector port assembly/chassis 102 interface. Shield 106 can be a strip that is made of a conductive material, such as a conductive fabric. Electromagnetic waves that would normally escape through spaces and gaps 104 that exist at the interface of connector port 100 and chassis 102 are instead reflected by the conductive material, thus preventing the escape of the electromagnetic waves. Shield 106 includes an outer portion 108 that is affixed to the interior surface 101 of chassis 102, around aperture 112 that is to receive connector 100 or the connector assembly (i.e., more than one conductor). Shield 106 also includes inner portion 110 that is not affixed to interior surface 101 of chassis 102. This inner portion 110 extends within aperture 112 and, after connector port 100 is inserted within chassis 102, can be bent to form a flap that covers the outer edges of connector port 100 or the connector port assembly in order to fill in spaces that might exist. In this fashion, shield 106 covers gaps 104 at the interface between conductor port 100, or the conductor ports 100 of a conductor port assembly, and chassis 102 thus lowering EMI.

It is understood that any specific order or hierarchy of steps in the processes disclosed is an illustration of exemplary approaches. Based upon design preferences, it is understood that the specific order or hierarchy of steps in the processes may be rearranged, or that only a portion of the illustrated steps be performed. Some of the steps may be performed simultaneously. For example, in certain circumstances, multitasking and parallel processing may be advantageous. Moreover, the separation of various system components in the examples described above should not be understood as requiring such separation in all examples, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more."

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

The specification and drawings are, accordingly, to be regarded in an illustrative rather than a restrictive sense. It will, however, be evident that various modifications and changes may be made thereunto without departing from the broader spirit and scope of various aspects of the disclosure as set forth in the claims.

We claim:

1. A method for limiting electromagnetic interference (EMI) at an interface between a connector port assembly and a chassis, the method comprising:

affixing, using glue, an outer portion of a conductive strip to an interior surface of a chassis, the chassis containing an aperture sized to receive a connector port assembly, the outer portion of the conductive strip disposed around a perimeter of the aperture;

inserting the connector port assembly within the aperture of the chassis, the connector port assembly containing one or more connector ports; and manipulating an inner portion of the conductive strip that is adjacent to the outer portion in order to cover one or more gaps between the connector port assembly and the chassis, wherein at least a portion of the inner portion extends uninterrupted across at least one length of the aperture and the inner portion has a width that is substantially the same as a thickness of a layer of the chassis, wherein the inner portion is manipulated such that it is flush with an external surface of the chassis.

2. The method of claim 1, wherein manipulating the inner portion of the conductive strip comprises bending the inner portion of the conductive strip so that the inner portion and the outer portion form a substantially 90 degree angle.

3. The method of claim 1, wherein the conductive strip includes conductive material on both sides of the conductive strip.

4. The method of claim 1, wherein the conductive strip includes conductive fabric.

5. The method of claim 1, wherein the conductive strip includes metal plating forming a conductive coating.

6. The method of claim 1, the inner portion of the conductive strip comprising a pliable region, wherein the pliable region at least partially covers a corresponding edge of the connector port assembly.

7. The method of claim 1, wherein, the width of the inner portion of the conductive strip is measured between the outer portion and the aperture, and the layer of the chassis is planar, of a uniform thickness, and defines the interior surface of the chassis.

8. A shield comprising:

a conductive strip sized to at least partially surround an aperture in a chassis, the chassis configured to receive a connector port assembly through the aperture, the conductive strip comprising:

an outer portion affixed to an interior surface of the chassis; and an inner portion adjacent to the outer portion, the inner portion able to be manipulated to at least cover one or more gaps between the connector port assembly and the chassis, the inner portion having a width that is substantially the same as a thickness of a layer of the chassis, and at least a portion of the inner portion extends uninterrupted across at least one length of the aperture, wherein the inner portion is manipulated such that it is flush with an external surface of the chassis.

9. The electromagnetic shield of claim 8, wherein the conductive strip is bent so that the inner portion and the outer portion form a substantially 90 degree angle.

10. The electromagnetic shield of claim 8, wherein the conductive strip includes conductive material on both sides of the conductive strip.

11. The electromagnetic shield of claim 8, wherein the conductive strip includes conductive fabric.

12. The electromagnetic shield of claim 8, wherein the conductive strip includes metal plating forming a conductive coating.

13. The electromagnetic shield of claim 8, the inner portion of the conductive strip comprising a pliable region, wherein the pliable region at least partially covers a corresponding edge of the connector port assembly.

14. The electromagnetic shield of claim 8, wherein, the width of the inner portion of the conductive strip is measured between the outer portion and the aperture, and the layer of the chassis is planar, of a uniform thickness, and defines the interior surface of the chassis.

15. A chassis comprising:

a receptacle for receiving a connector port assembly therethrough, the receptacle having an interior surface and an exterior surface; and a conductive strip surrounding an aperture formed in the receptacle, the conductive strip comprising:

an outer portion affixed to the interior surface of the receptacle; and an inner portion adjacent to the outer portion and with a width that is substantially the same as a thickness of a layer of the receptacle, the inner portion adapted to be manipulated in order to cover one or more gaps between the connector port assembly and the receptacle, wherein at least a portion of the inner portion extends uninterrupted across at least one length of the aperture, wherein the inner portion is manipulated such that it is flush with the exterior surface of the receptacle.

16. The chassis of claim 15, wherein the conductive strip includes conductive material on both sides of the conductive strip.

17. The chassis of claim 15, wherein the conductive strip includes conductive fabric.

18. The chassis of claim 15, wherein the conductive strip includes metal plating forming a conductive coating.

19. The chassis of claim 15, the inner portion of the conductive strip comprising a pliable region, wherein the pliable region at least partially covers a corresponding edge of the connector port assembly.

20. The chassis of claim 15, wherein, the width of the inner portion of the conductive strip is measured between the outer portion and the aperture, and the layer of the receptacle is planar, of a uniform thickness, and defines the interior surface of the receptacle.

* * * * *